US008042709B2

(12) United States Patent
Duquet

(10) Patent No.: US 8,042,709 B2
(45) Date of Patent: Oct. 25, 2011

(54) FLUID DISPENSER DEVICE

(75) Inventor: Frederic Duquet, Thibouville (FR)

(73) Assignee: Valois SAS, Le Neubourg (FR)

( * ) Notice: Subject to any disclaimer, the term of this patent is extended or adjusted under 35 U.S.C. 154(b) by 366 days.

(21) Appl. No.: 12/428,894

(22) Filed: Apr. 23, 2009

(65) Prior Publication Data

US 2009/0266845 A1 Oct. 29, 2009

Related U.S. Application Data

(60) Provisional application No. 61/089,122, filed on Aug. 15, 2008.

(30) Foreign Application Priority Data

Apr. 25, 2008 (FR) ..... 08 52798

(51) Int. Cl.
*B65D 83/22* (2006.01)
*B67D 1/00* (2006.01)

(52) U.S. Cl. ..... 222/153.13; 222/153.11; 222/153.14; 222/402.11

(58) Field of Classification Search ..... 222/153.01, 222/153.04, 153.11, 153.13, 153.14, 321.7, 222/402.11, 522
See application file for complete search history.

(56) References Cited

U.S. PATENT DOCUMENTS

| | | | | |
|---|---|---|---|---|
| 4,848,595 | A * | 7/1989 | Foster et al. | 222/153.13 |
| 5,544,789 | A * | 8/1996 | Gillingham | 222/153.13 |
| 5,971,215 | A * | 10/1999 | Bartsch | 222/153.13 |
| 2003/0047571 | A1 * | 3/2003 | Ramsey et al. | 222/321.9 |
| 2007/0257060 | A1 * | 11/2007 | Young et al. | 222/153.13 |

FOREIGN PATENT DOCUMENTS

| | | | |
|---|---|---|---|
| EP | 0 779 106 | A2 | 6/1997 |
| EP | 1 837 082 | A1 | 9/2007 |
| WO | 98/09732 | A1 | 3/1998 |

* cited by examiner

*Primary Examiner* — Darren W Gorman
(74) *Attorney, Agent, or Firm* — Sughrue Mion, PLLC

(57) ABSTRACT

A fluid dispenser device having an outlet valve (22, 36) including a seat (22) and a movable member (36) that is urged in leaktight manner against the seat (22), the dispenser device being switchable between a locked position and a working position in which the outlet valve (22, 36) is closed, the dispenser device not being actuatable in the locked position, but being actuatable in the working position, the movable member (36) being urged by at least one resilient element (42) against the seat (22) in the working position, the dispenser device being characterized in that, in the locked position, the movable member (36) is urged against the seat (22) by at least one bearing element (41) other than the at least one resilient element (42).

12 Claims, 4 Drawing Sheets

FLUID DISPENSER DEVICE

CROSS REFERENCE TO RELATED APPLICATION

This application claims the benefit under 35 U.S.C. §119 (e) of pending U.S. provisional patent application Ser. No. 61/089,122, filed Aug. 15, 2008, and priority under 35 U.S.C. §119(a)-(d) of French patent application No. FR-08.52798, filed Apr. 25, 2008.

TECHNICAL FIELD

The present invention relates to a fluid dispenser device for associating with a fluid reservoir, thereby constituting a fluid dispenser. By actuating the dispenser device, optionally-metered fluid is taken from the fluid reservoir and delivered to a fluid outlet, e.g. in spray form, or in the form of a thread or a bead. In particular, such a dispenser device may be used in the fields of perfumery, of cosmetics, or even of pharmacy.

BACKGROUND OF THE INVENTION

In entirely conventional manner, fluid dispenser devices include an outlet valve that is formed by a valve seat, and by a movable member that is urged in leaktight manner against the valve seat. This applies with numerous fluid dispenser devices, such as pumps or valves, for example. The outlet valve is formed at the outlet of the chamber in which the fluid is put in under pressure. The valve opens when the pressure in the chamber reaches a predetermined value. The valve opens by lifting the movable member off its seat, thereby defining a passage for the fluid under pressure. This is an entirely conventional characteristic for an outlet valve of a dispenser pump or valve.

In order to provide good sealing, particularly at rest, the outlet valve should be stressed so that the movable member exerts pressure against the seat. In entirely conventional manner, a return or pre-compression spring is used to urge the movable member against its valve seat in resilient constant manner. Naturally, it is necessary that the stiffness of the spring does not weaken, so as to guarantee that the movable member is urged resiliently against its seat in satisfactory manner over time. A loss of stiffness in the spring could lead to a failure of sealing at the outlet valve, and the dispenser device could thus no longer fulfill its purpose. Specifically, the dispenser device could leak at rest.

In addition, dispenser devices are already known that are switchable between a locked position in which the device cannot be actuated, and a working position in which the device can be actuated. In both positions, the outlet valve is closed. The working position corresponds to the rest position of the device, from which the dispenser device can be actuated so as to open the outlet valve. In order to move the dispenser device from one position to the other, it is already known to use relative movement, such as turning movement or movement in translation, for example.

In dispenser devices equipped with a locking mechanism, there is no interaction between the switching of the device and the force exerted by the spring in order to press the movable member against its valve seat. Consequently, the spring exerts its force against the movable member whether in the working position or in the locked position.

BRIEF SUMMARY OF THE INVENTION

An object of the present invention is to relieve the action of the spring when the dispenser device is not used. Another object is to keep the movable member urged against its seat other than by means of the spring. Still another object is to use the prior-art locking mechanism to supplant the action of the spring against the movable member.

To achieve these objects, the present invention proposes a fluid dispenser device having an outlet valve comprising a seat and a movable member that is urged in leaktight manner against the seat, the dispenser device being switchable between a locked position and a working position in which the outlet valve is closed, the dispenser device not being actuatable in the locked position, but being actuatable in the working position, the movable member being urged by resilient means against the seat in the working position, the dispenser device being characterized in that, in the locked position, the movable member is urged against the seat by bearing means other than the resilient means. Thus, the locking mechanism is used not only to prevent the dispenser device from being actuated, but also to press the movable member against its seat, taking the place of the resilient means. Advantageously, the bearing means are substantially rigid, such that they are not resilient. The resilient means are advantageously relaxed in the locked position, such that they are not subjected to any stress or deformation. The resilient means are preferably formed of plastics material. In the prior art, there have already been numerous attempts to replace the metal springs with plastics springs. However, as a result of being stressed permanently so as to press the movable member against the seat of the outlet valve member, such plastics springs tend to deform by creep, such that they no longer have any stiffness and can no longer fulfill their function at rest. After a few weeks or months, which can correspond to the period between manufacturing the dispenser device and selling it to a consumer, the plastics spring can lose its stiffness, and sealing of the outlet valve member is no longer guaranteed. Nevertheless, operation of the dispenser device can be acceptable, given that the spring still conserves enough stiffness to return the movable member into the proximity of its seat, but without guaranteeing sealing. This is why a dispenser device integrating a plastics spring has not yet been put on the market. By means of the present invention, this is now possible, given that it is not the resilient (or spring) means that urge the movable member against the outlet-valve seat. The resilient means can thus conserve all of their stiffness over the period between manufacturing the dispenser device and selling it to the consumer. The bearing means present almost no elasticity, such that the force exerted by the bearing means on the movable member is constant over time. It is only when the user wishes to use the dispenser device that the resilient means are brought into action. After actuating the device, the user returns the device into its locked position, in which the resilient means once again no longer provide sealing of the outlet valve member.

According to an advantageous characteristic of the invention, switching between the locked position and the working position may be generated by relative movement between at least a portion of the outlet valve and the resilient means. The relative movement is preferably turning movement. Movement in translation, or even a movement combining both turning movement and movement in translation is also possible. Advantageously, the dispenser device further includes a pusher on which the user presses so as to actuate the dispenser device, the pusher being turned so as to switch from one position to the other.

In another aspect of the invention, the resilient means exert a force along an axis X, the movable member of the valve being urged against the seat in the direction of the axis X. Preferably, the resilient means comprise at least two resilient elements that are distributed about the axis X, and the bearing means comprise at least two bearing elements that are distributed about the axis X. The resilient elements and the bearing elements may thus be distributed in alternating manner about the axis X in the form of a crown. The resilient means and the bearing means are preferably made integrally of plastics material. The resilient means and the bearing means may constitute a separate part, or they may be made integrally with another component element of the dispenser device, e.g. the body of the device for mounting on a reservoir.

In another aspect of the invention, the movable member is secured to at least one contact zone bearing against the resilient means or the bearing means. Advantageously, the movable member is formed integrally with at least one axial tab defining said at least one contact zone.

A principle of the present invention is to use the locking mechanism already known in the prior art to fulfill a novel function, namely a function of sealing the outlet valve at rest. Thus, the non-resilient rigid locking thrust is used to urge the movable member against its seat in constant manner.

BRIEF DESCRIPTION OF THE DRAWINGS

The invention is described more fully below with reference to the accompanying drawings which show two embodiments of the present invention by way of non-limiting example.

In the figures.

DETAILED DESCRIPTION OF THE INVENTION

Figure 2:
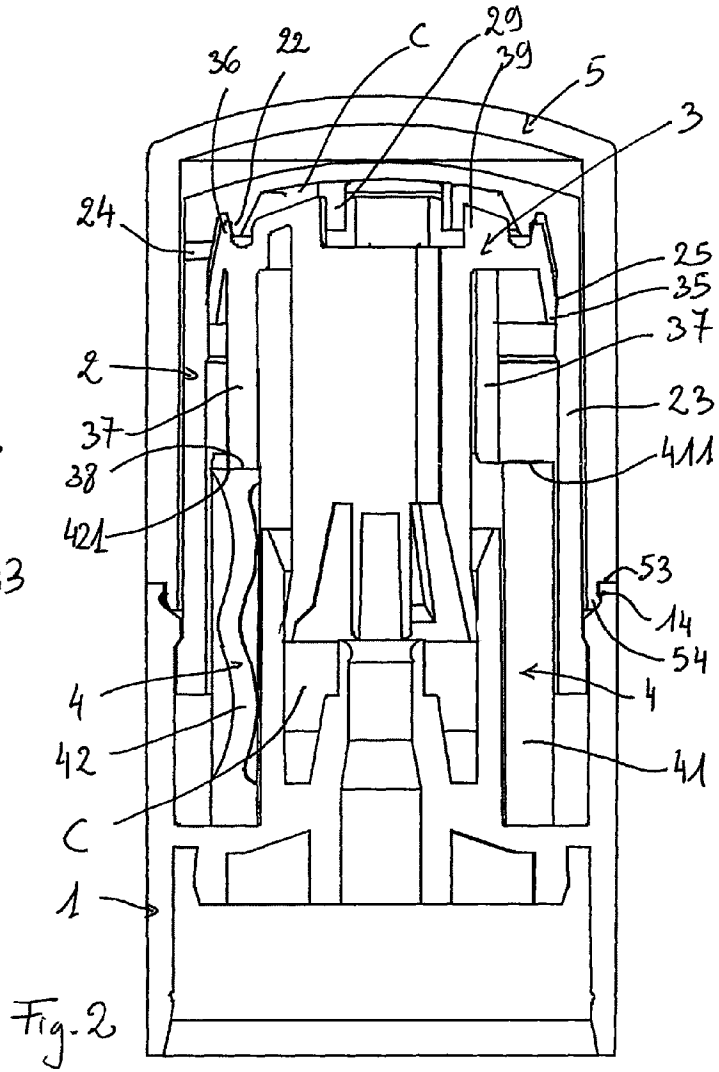
FIGS. 1 and 2 are vertical-section views through a dispenser device constituting a first embodiment of the invention, respectively in the locked position and in the working position.
Figure 1:
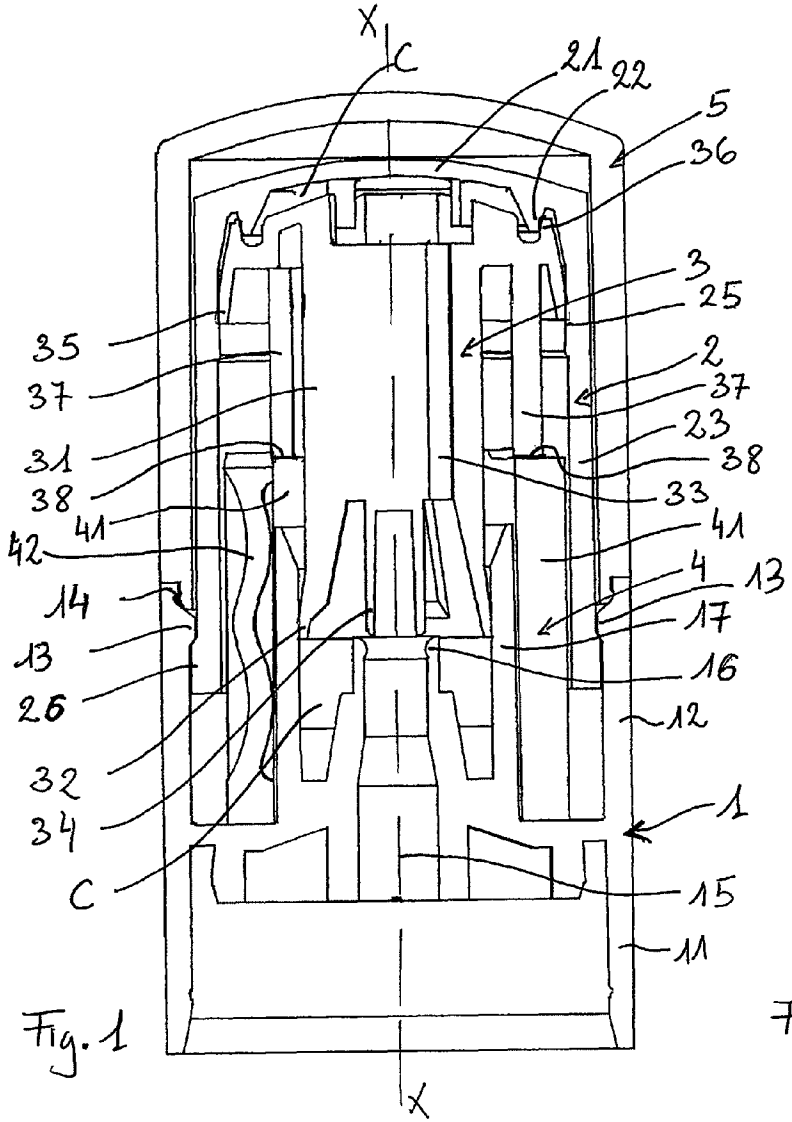

Reference is made firstly to FIGS. 1 and 2 in order to describe the general structure of a dispenser device constituting a first embodiment of the invention. In this illustrative example, the dispenser device is a pump, but it could equally well be a valve. In the description below, reference is made to a pump as the dispenser device, without that being limiting. Thus, the pump in FIGS. 1 and 2 comprises four component elements, plus one optional element, namely: a body 1; a pusher 2; a piston element 3; a drive part 4; and a protective cap 5 that is optional. All of the elements can be made by injection-molding plastics material. In a variant, some elements can be made of metal, e.g. the protective cap 5. The dispenser device is for associating with a fluid reservoir (not shown), thereby constituting a fluid dispenser.

The body 1 includes a fastener ring 11 for coming into engagement, e.g. snap-fastening or screw-fastening engagement, with an opening of a fluid reservoir that can be in the form of a projecting neck. The ring 11 can come into engagement around the neck, or, in a variant, inside the neck. It is essential for the ring 11 to be fastened on the opening of the reservoir in strong and leaktight manner. The body 1 also forms a bushing 12 that extends upwards in register with the ring 11 in this embodiment. In the proximity of its free top end, the bushing 12 defines an annular abutment bead 13 that can be continuous or discontinuous. In addition, at its top end, the bushing 12 defines an inner annular housing 14 for receiving the cap 5. To this end, in the proximity of its free bottom end, the cap 5 presents a shoulder 53 that is downwardly-directed, and an inner flange 54 that is provided with a snap-fastener bead that is adapted to be received in the housing 14 formed by the bushing 12. It should be observed that the shoulder 53 and the flange 54 are formed in the wall thickness of the cap 5. Thus, the shoulder 53 can come into clear and firm abutment against the top edge of the bushing 12 without revealing the inner flange 54 that is snap-fastened in the housing 14. This is an advantageous characteristic that can be protected independently and implemented on any kind of fluid dispenser.

The body 1 also defines an inlet 15 for fluid coming from the reservoir (not shown). The top end of the duct 15 forms an inlet-valve seat 16. Around the duct 15 there extends a slide cylinder 17 that co-operates with the piston element 3, as described below. The cylinder 17 extends coaxially around the duct 15 and coaxially inside the bushing 12. A substantially cylindrical annular gap is thus defined between the bushing 12 and the cylinder 17. The gap receives both the drive part 4 and the bottom end of the pusher 2.

The pusher 2 includes a bearing surface 21 on which the user can press using one or more fingers. In addition, the pusher includes a substantially-cylindrical side skirt having a bottom end that is formed with an outer reinforcement 26 that is received inside the bushing 12. The reinforcement 26 can co-operate with the bead 13 so as to form an abutment, thereby defining the rest position of the pump. The bearing surface 21 internally defines an annular seat 22 for the outlet valve of the pump. The skirt 23 forms a dispenser orifice 24 that passes through the wall thickness of the skirt. The orifice 24 is situated in the proximity of the valve seat 22. Below the orifice 24, the skirt 23 forms a slide section 25.

The piston element 3 is made as a single part that is housed inside the pusher 2. The piston element 3 includes a main piston lip 32 that is engaged to slide in leaktight manner in the cylinder 17, and a differential piston lip 35 that is engaged to slide in the slide section 25 of the skirt of the pusher. The two lips 32 and 35 are connected together via an axial trunk 31 through which there passes a through duct 33. The piston element also forms a movable outlet valve 36 that is adapted to co-operate with the valve seat 22 so as to form together the outlet valve of the pump. The movable member 36 is in the form of an annular crown for coming into engagement around the annular seat 22. The outlet valve defines the outlet of the pump chamber C that is defined on either side of the piston element 3. A portion of the chamber C is formed between the piston element 3 and the bearing surface 21, and another portion of the chamber C is formed inside the cylinder 17. The two chamber portions communicate with each other via the through duct 33. In addition, the piston element 3 forms a movable inlet valve 32 that is adapted to co-operate with the seat 16 formed by the body 1. In the two positions shown in FIGS. 1 and 2, the closed outlet valve prevents any communication between the chamber C and the dispenser orifice 24. In contrast, the inlet valve is open and communicates with the reservoir.

In the invention, the piston element 3 further includes one or more thrust transmission elements that, in this embodiment, are in the form of axial tabs 37 that extend downwards around the trunk 31, from the section connecting the trunk 31 to the lip 35 and to the movable member 36. The axial tabs 37 are situated substantially radially at the same level as the movable member 36. The free bottom ends of the tabs 37 define contact zones 38 that are adapted to come into contact with the drive part 4.

The function of the drive part 4 is to urge the movable member 36 of the outlet valve towards its valve seat 22. The drive exerted by the part 4 is transmitted to the movable member 36 via the axial tabs 37 that thus perform a thrust transmission function. The drive part 4 exerts either resilient thrust, or non-resilient rigid thrust.

Figure 4:
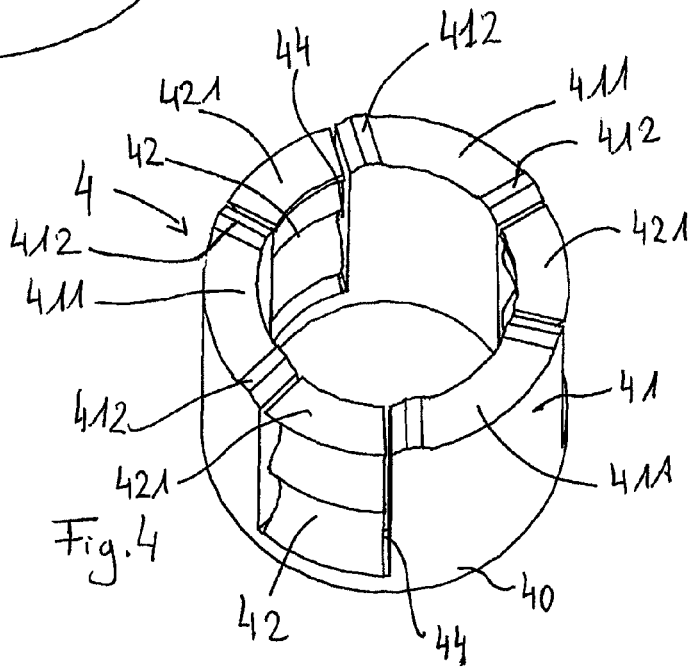
FIG. 4 is a perspective view of the spring/locking crown used in the device in FIGS. 1 to 3.

In this embodiment, the drive part 4 is in the form of a substantially-cylindrical sleeve that comprises six segments that are separated by slots 44. The six segments are connected together by a common base 40. Amongst the six segments, there are three resilient elements 42 and three rigid bearing elements 41. The resilient elements 42 and rigid elements 41 are disposed in alternation, such that each resilient element is adjacent to two rigid elements, and vice versa. At their free ends remote from the common base 40, the resilient elements 42 form a bearing zone 421. Similarly, the rigid bearing elements 41 define bearing zones 411. The bearing zones 411 and 421 together define the top edge of the drive part 4, as can be seen in FIG. 4. However, the edge is interrupted by the slots 44. Each bearing zone 411 is further provided with two beads 412 that project from the bearing zone 411. It can easily be understood that the rigid bearing elements 41 are not axially deformable, whereas the resilient elements 42 can be subjected to axial elastic deformation by bearing on their bearing surfaces 421. The three bearing elements 42 thus fulfill a spring or resilient means function by axial bearing.

The drive part 4 is disposed around the cylinder 17 in the gap formed between the bushing 12 and the cylinder 17. The common base 40 of the drive part 4 bears on a connection flange that connects the bushing 12 to the cylinder 17, as can be seen in FIGS. 1 and 2. The bearing surfaces 411 and 421, belonging to the resilient elements 42 and to the rigid bearing elements 41 respectively, are situated just below the axial tabs 37 formed by the piston element 3.

Figure 3:
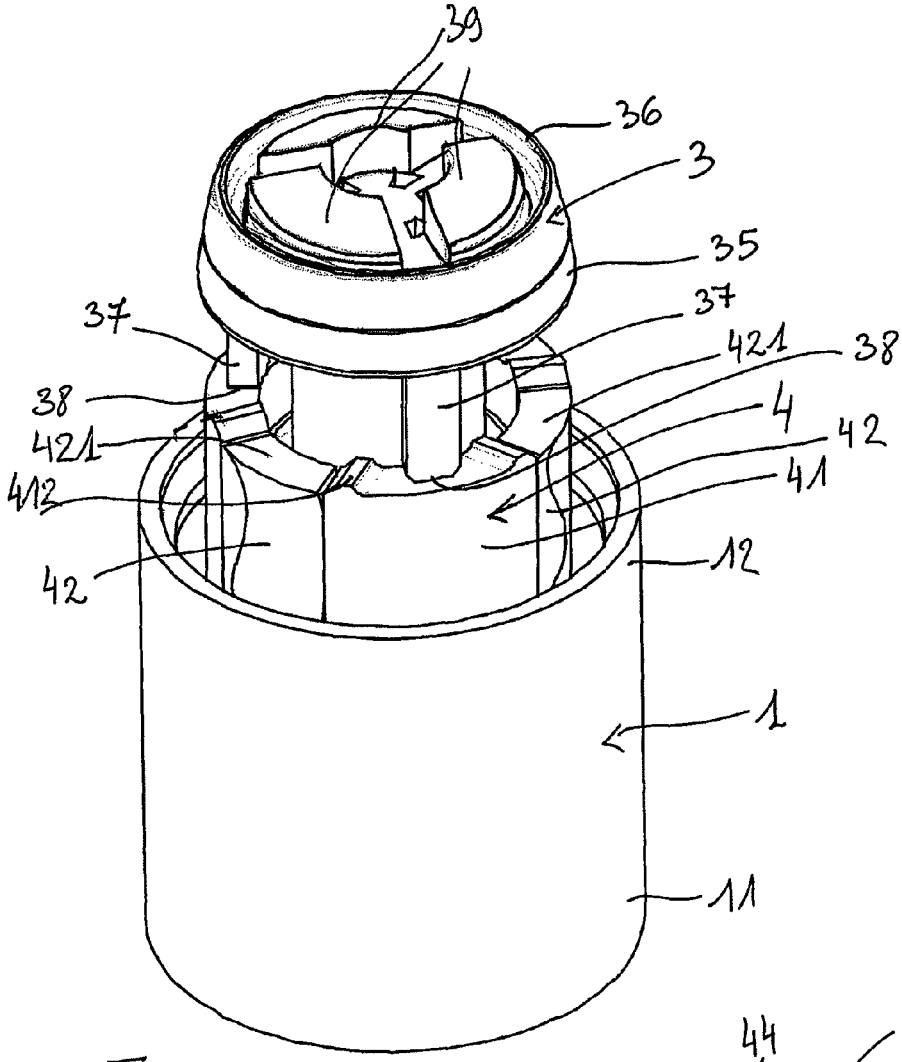
FIG. 3 is a perspective view in the locked position with the pusher removed so as to reveal the internal mechanism of the device.
Figure 5:
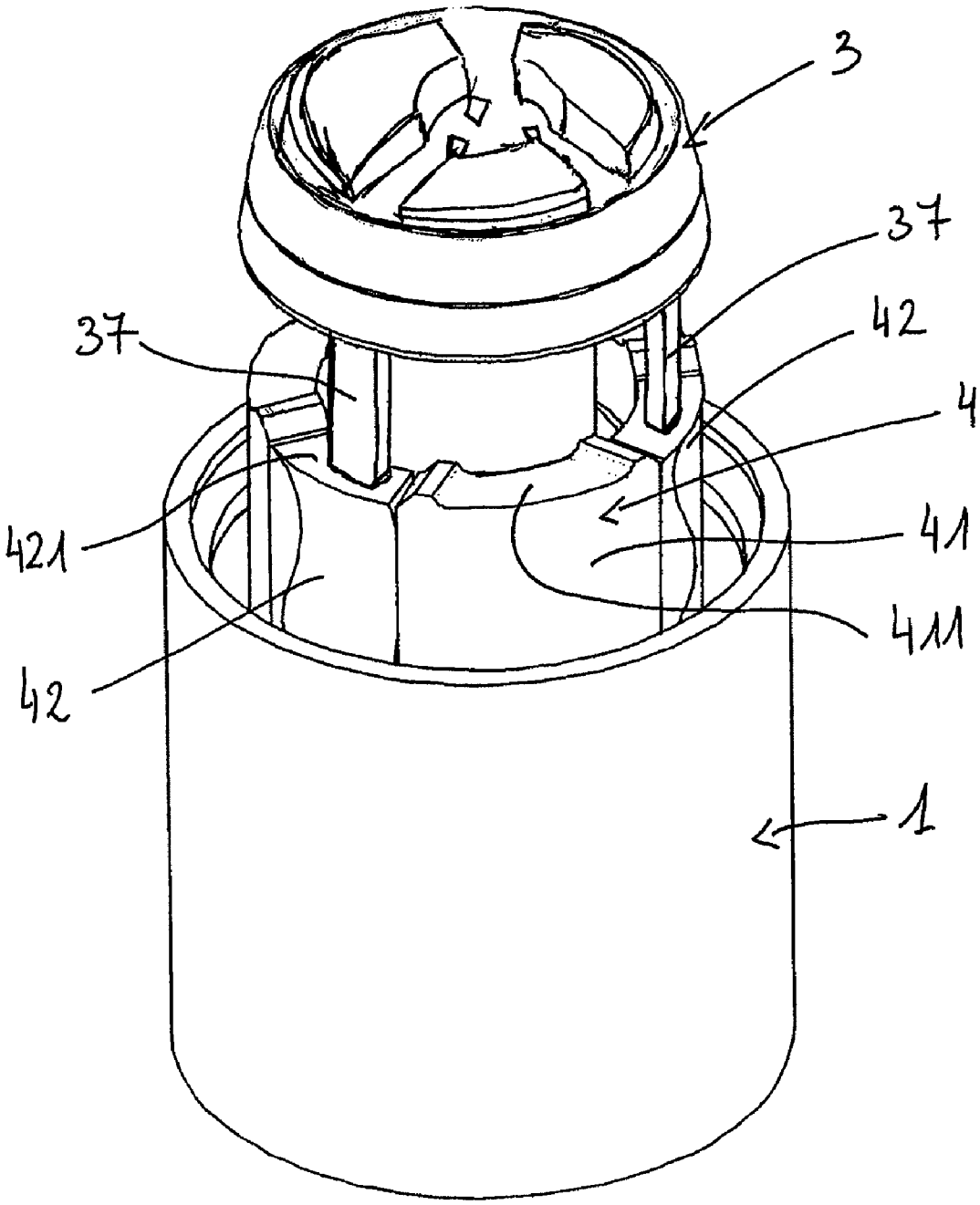
FIG. 5 is a view similar to the view in FIG. 3 in the working position.

FIGS. 1 and 3 show the pump in a locked position in which it is not possible to actuate the pump. FIGS. 2 and 5 show the pump in a working position that can also be said to be a rest position from which the pump can be actuated. In both the locked and working positions, the various component elements of the pump are situated in the same axial positions. In particular, the outlet valve is closed and the inlet valve is open. The pusher 2 is in abutment against the bead 13. In contrast, the relative angular positions between the piston element 3 and the drive part 4 are different.

In FIGS. 1 and 3 corresponding to the locked position, the bearing surfaces 38 of the axial tabs 37 of the piston element 3 are in contact with the bearing zones 411 of the rigid bearing elements 41. Contact between the tabs 37 and the bearing elements 41 is engaged, such that a force is exerted by the bearing elements 41 against the tabs 37 that transmit said force onto the movable member 36 that, in turn, bears strongly against the outlet valve seat 22. Given that the bearing elements 41 are rigid, and consequently not resilient and not deformable, the pressure exerted against the tabs 37 and against the movable member 36 is constant. As a result of the bearing elements 41 not being elastically deformable, it is not possible to move the pusher 2 axially, and thus actuate the pump. This is why the position is designated under the term "locked position". It should be observed that the resilient elements 42 are not stressed in the locked position. The bearing zones 421 of the resilient elements 42 are not in contact with the tabs 37, nor with any other element of the pump. As a result, the resilient elements 42 are completely at rest in the locked position. They are not subjected to any stress. In order to pass from the locked position in FIGS. 1 and 3 to the working, but nevertheless rest position in FIGS. 2 and 5, it suffices to turn the piston element 3 relative to the drive part 4. The piston element 3 can be turned very simply by turning the pusher 2. In order to guarantee turning of the piston element 3, rotation-prevention means can be provided, e.g. such as those provided at the top end of the piston element 3 and the bottom face of the bearing surface 21. The rotation-prevention means are referenced 39 and 29 respectively in the figures. Thus, turning the pusher 2 causes the tabs 37 of the piston element 3 to turn, thereby moving the tabs from the bearing zones 411 of the bearing elements 41 to the bearing zones 421 of the resilient elements 42. In order to switch from the locked position to the working position, the contact surfaces 38 of the tabs 37 must pass over the beads 412. Passage over the beads can be seen by the user, who thus knows that passage has taken place from one position to the other.

The working, but nevertheless rest position is shown in FIGS. 2 and 5. It can clearly be seen that the tabs 37 come into contact with the resilient elements 42. In this position, it is possible to move the pusher 2 axially by pressing on its bearing surface 21. This results in the working volume of the pump chamber C being reduced, and the fluid content being put under pressure. The pressure causes the piston element 3 to be moved relative to the pusher 2, thereby lifting the movable member 36 off its valve seat 22. The fluid under pressure inside the chamber C thus finds an outlet passage towards the dispenser orifice 24. When the pressure inside the chamber C drops, the resilient elements 42 return the piston element 3 into its rest position, thereby closing the outlet valve. This operating cycle is entirely conventional for such a pump.

As seen above, the pump of the invention is switchable between a locked position in which the outlet valve is urged into the closed position by the rigid bearing means 41, and a working, but nevertheless rest position in which the outlet valve is urged into the closed position by resilient means that then perform a normal function of a return or pre-compression spring while the pump is being actuated. The resilient means remain completely at rest while in the locked position. In this way, they are subjected to stress for only a very short period that corresponds to periods during which the pump is actuated. In any event, between manufacture and first use of the pump by the user, the pump is in the locked position.

In the embodiment used to illustrate the present invention, switching between the locked position and the working position is performed by turning the drive part 4 and the piston element 3 relative to each other. However, without going beyond the ambit of the present invention, it can be envisaged that switching between the locked and working positions is generated by some other kind of movement, e.g. movement in translation or even a combination of movement in translation and turning movement. In addition, the drive part 4 is presented as a separate part that is fitted inside the pump. However, without going beyond the ambit of the present invention, it is possible to envisage forming the drive part 4 integrally with the body 1 or with the piston element 3.

Figure 6:
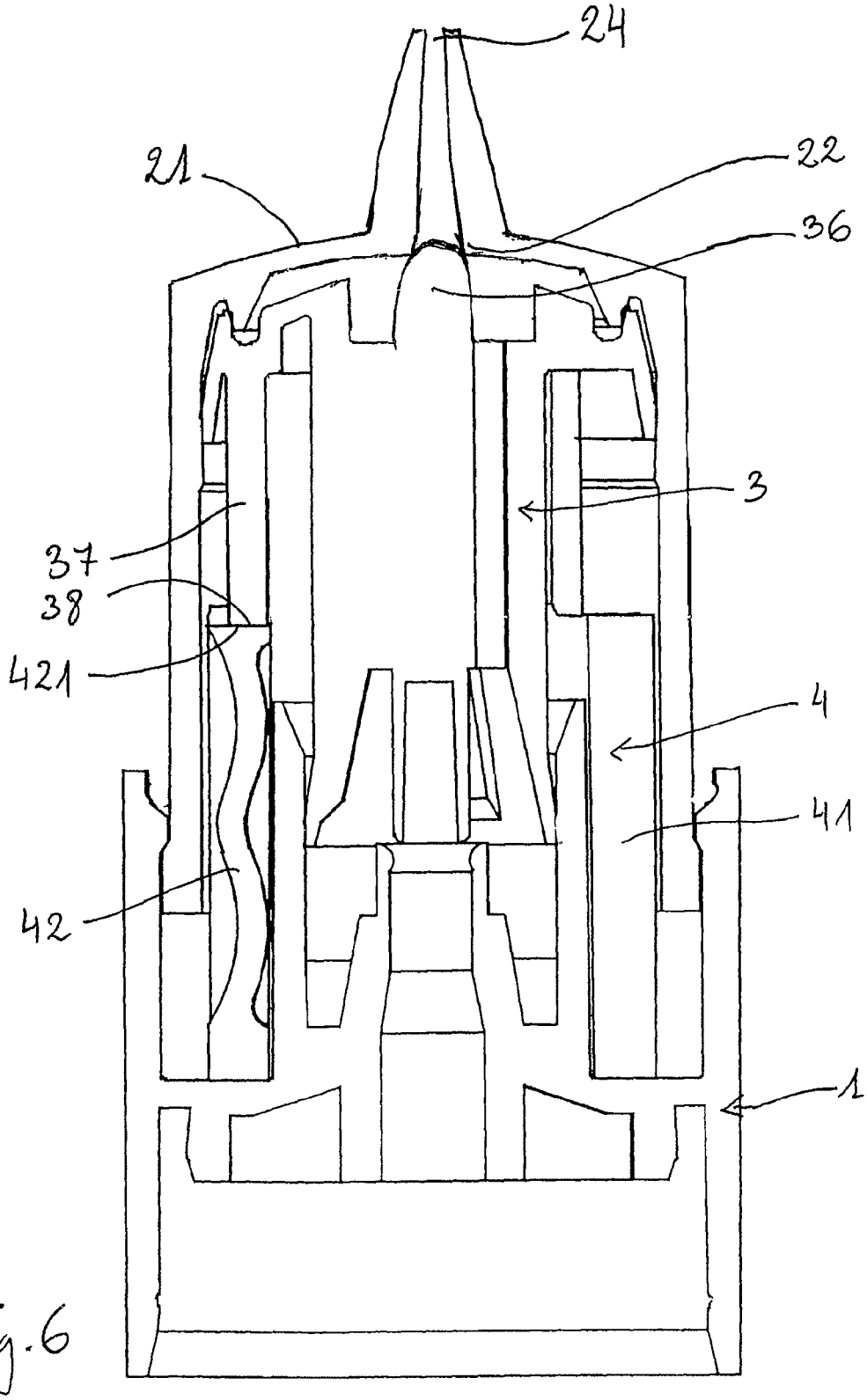
FIG. 6 is a view similar to the views in FIGS. 1 and 2, showing a second embodiment of the invention.

Reference is made below to FIG. 6 that shows a second embodiment that can be considered as a variant of the first embodiment. In the first embodiment, the dispenser orifice 24 is situated laterally in the skirt of the pusher. In this second embodiment, the dispenser orifice 24 is situated in axial manner in the form of an endpiece projecting from the bearing surface 21. In addition, the position of the outlet valve has been changed: the movable member 36 is in the form of an axial stud for coming into sealed contact with a seat 22 that is formed at the base of the endpiece. Except for the positioning of the outlet valve and of the dispenser orifice, the other elements of the pump can be identical to the other elements of the first embodiment.

The present invention is described with reference to a pump, and more particularly to a pump including a differential piston. However, the present invention can be implemented in any kind of pump or valve. The principle of the invention resides in the fact that it is not the return or pre-compression spring that provides sealing for the outlet valve when that is not necessary. The resilient means providing this return or pre-compression spring function are preferably made of plastics material. By means of the invention, there is no risk of the spring losing stiffness as a result of the plastics material creeping under stress.

The invention claimed is:

1. A fluid dispenser device having an outlet valve (22, 36) comprising a seat (22) and a movable member (36) that is urged in leaktight manner against the seat (22), the dispenser device being switchable between a locked position and a working position in which the outlet valve (22, 36) is closed, the dispenser device not being actuatable in the locked position, but being actuatable in the working position, the movable member (36) being urged by resilient means (42) against the seat (22) in the working position, the dispenser device being characterized in that, in the locked position, the movable member (36) is urged against the seat (22) by bearing means (41) other than the resilient means (42).

2. A dispenser device according to claim 1, in which the bearing means (41) are substantially rigid, such that they are not resilient.

3. A dispenser device according to claim 1, in which the resilient means (42) are relaxed in the locked position, such that they are not subjected to any stress or deformation.

4. A dispenser device according to claim 1, in which the resilient means (42) are formed of plastics material.

5. A dispenser device according to any claim 1, in which switching between the locked position and the working position is generated by relative movement between at least a portion (36) of the outlet valve and the resilient means (42).

6. A dispenser device according to claim 5, in which the relative movement is turning movement.

7. A dispenser device according to claim 6, further including a pusher (2) on which the user presses so as to actuate the dispenser device, the pusher (2) being turned so as to switch from one of the locked position and the working position to the other of the locked position and the working position.

8. A dispenser device according to claim 1, in which the resilient means (42) exert a force along an axis X, the movable member (36) of the valve being urged against the seat (22) in the direction of the axis X.

9. A dispenser device according to claim 8, in which the resilient means (42) comprise at least two resilient elements that are distributed about the axis X, and the bearing means (41) comprise at least two bearing elements that are distributed about the axis X.

10. A dispenser device according to claim 1, in which the resilient means (42) and the bearing means (41) are made integrally of plastics material.

11. A dispenser device according to claim 1, in which the movable member (36) is secured to at least one contact zone (38) bearing against the resilient means (42) or the bearing means (41).

12. A dispenser device according to claim 11, in which the movable member (36) is formed integrally with at least one axial tab (37) defining said at least one contact zone (38).

* * * * *